United States Patent [19]

Aubry et al.

[11] Patent Number: 4,922,825

[45] Date of Patent: May 8, 1990

[54] CORE-FORMING EXPLOSIVE CHARGE

[75] Inventors: Julien Aubry, Pavillons sous Bois; Richard J. Durand; Alain L. Kerdraon, both of Bourges; Gérard Solve, Gramat, all of France

[73] Assignee: L'Etat Francais represente par le Delegue Ministeriel pour l'Armement, Paris Armees, France

[21] Appl. No.: 75,677

[22] Filed: Jun. 24, 1987

[30] Foreign Application Priority Data

Jul. 24, 1986 [FR] France ..... 86 10738

[51] Int. Cl.[5] ..... F42B 1/02

[52] U.S. Cl. ..... 102/476

[58] Field of Search ..... 102/306, 307, 308, 309, 102/310, 476, 501

[56] References Cited

U.S. PATENT DOCUMENTS

| | | | |
|---|---|---|---|
| 3,025,794 | 3/1962 | LeBourg et al. | 102/306 |
| 3,235,005 | 2/1966 | Delacour | 102/306 |
| 3,237,559 | 3/1966 | Auberlinder | 102/306 |
| 3,478,685 | 11/1969 | Thomanek et al. | 102/306 |
| 4,498,367 | 2/1985 | Skolnick et al. | 102/306 |
| 4,537,132 | 8/1985 | Sabranski et al. | 102/476 |
| 4,598,884 | 7/1986 | Speer | 102/476 |
| 4,702,171 | 10/1987 | Tal et al. | 102/476 |

FOREIGN PATENT DOCUMENTS

| | | | |
|---|---|---|---|
| 360315 | 3/1962 | Switzerland | 102/476 |
| 832685 | 4/1960 | United Kingdom | 102/306 |

*Primary Examiner*—Charles T. Jordan
*Assistant Examiner*—Michael J. Carone
*Attorney, Agent, or Firm*—Oliff & Berridge

[57] ABSTRACT

The technical sector of the invention is that of explosive charges with a core-forming coating. This explosive charge is characterized by the fact that the coating includes two superimposed and contiguous plates. The plate in contact with the air has a lower density than that of the plate in contact with the explosive matter, and its compressibility is less than or equal to 50% under a pressure of 50 Gigapascals.

11 Claims, 3 Drawing Sheets

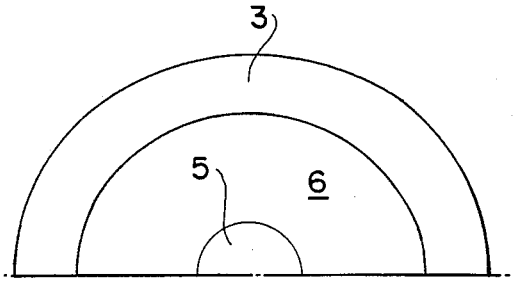
Fig. 5
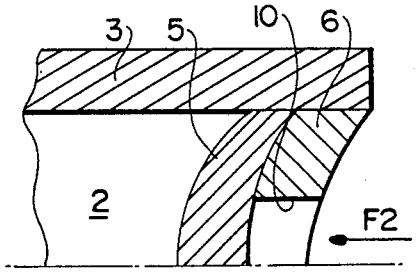
Fig. 4
Fig. 6
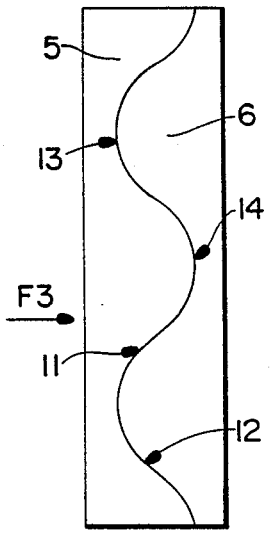
Fig. 7
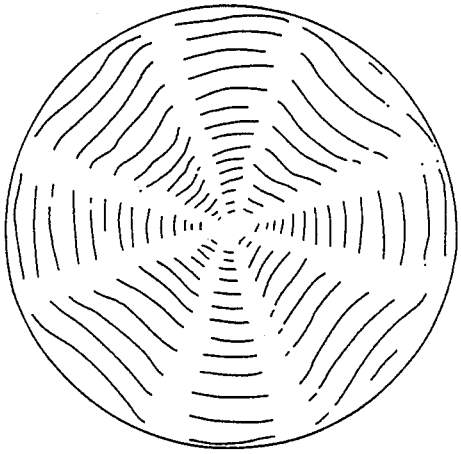

CORE-FORMING EXPLOSIVE CHARGE

BACKGROUND OF THE INVENTION

The present invention relates to a core-forming explosive charge. Such charges are constituted in a well known manner by an explosive matter including on its face oriented toward the target a cavity, conical for example, with a vertex angle greater than 110° and covered with a metal coating usually with a density greater than that of iron.

The detonation of the explosive matter generates very high pressure levels which result in the deformation of the coating and its transformation into a projectile the velocity of which is on the order of one to two kilometers per second.

These charges are called "flat charges" in contradistinction to the so-called "hollow charges" for which the cone vertex angle is greater than 90°, the latter charges forming an elongated jet-shaped projectile which is more fragile in regard to modern armor plates than the core formed by a flat charge.

Depending on the state of the art, flat charges are constituted by a coating made of a dense and usually metallic material, in contact on one side with the explosive matter and, on the other, with the air. Thus, upon detonation, the constituent material of the coating is subjected on one of its faces to a compression stress on the order of a few tens of Gigapascals and, on the other face, to a virtually null expansion-resistance exerted by the air. Consequently, the tensions accumulated in the coating can be released without any attenuation; this sudden expansion in contact with the air results usually in a scaling and a decoherence of the constituent material of the coating, particularly at its periphery. Consequently an important part of the coating mass will not be retained in the projected core, resulting in a poor energetic efficiency of the explosive charge. Therefore, it is impossible to use a "thick" coating (thickness greater than 10% and even 5% of the explosive charge length), as the mass losses in the matter transfer from the coating to the core are too high.

SUMMARY OF THE INVENTION

The aim of the present invention is to propose a type of explosive charge organization permitting formation of cores which possess the totality of the coating mass.

Another aim of the present invention is to provide a core which is aerodynamically stable on its trajectory.

For that purpose, the invention proposes a core-forming explosive charge, including a coating set in motion by an explosive matter initiated by a priming device, characterized by the fact that the coating consists of two superimposed and contiguous plates, a so-called internal plate intended to form the core, one face of which is in contact with the explosive matter, and a so-called external plate, one face of which is oriented toward the open air, and by the fact that the external plate is made of a material such that: its density is included between 10% and 55% of the density of the internal plate constituent material, its compressibilty under 50 Gigapascals is less than or equal to 50%, the total mass of the external plate is smaller than the total mass of the internal plate, and the external plate thickness on its edges being greater than 125% of the internal plate thickness on its edges.

According to the preferred embodiment, the area of contact of the internal plate with the external plate is a conical area the apex of which is oriented toward the explosive matter, the apex angle being greater than or equal to 110°.

According to another embodiment, the area of contact of the internal plate with the external plate is a spherical area the convexity of which is oriented toward the explosive matter and the diameter of which is greater than 0.5 times the diameter of the explosive matter.

Advantageously, the external plate thickness will be decreasing from its edges to its center, while the internal plate thickness may be increasing from its edges to its center.

According to a variant of embodiment, the external plate may be annular.

On the area of the external plate in contact with the internal plate, it may be possible to create a certain number N of radial grooves starting from the edges and forming an angle of $2\pi/N$ radians with one another.

According to another embodiment, the relative areas of contact between the external plate and the internal plate include undulations a certain number P of which correspond to a reduced plate thickness, the areas of contact showing a symmetry of $P^{th}$ order with regard to their respective axes.

Conveniently, the internal plate may be made of the following materials: Uranium, Tantalum, whereas the external plate is made of one of the following materials, whether alloyed or not: Iron, Nickel, Aluminum, Titanium, Glass. One may also choose an internal plate made of Iron, Copper, Nickel or Mobybdenum with an external plate made of Titanium, Aluminum, Magnesium or Glass.

Lastly, the priming device may advantageously be a detonation plane wave generator.

Other specificities and advantages in connection with the invention will also be highlighted by the following detailed description, a description made in association with the attached drawings in which:

BRIEF DESCRIPTION OF THE DRAWINGS

FIGS. 2 and 4 show two particular embodiments represented by a partial half-section, while FIGS. 3 and 5 are respective views of the same two embodiments, in directions F1 and F2 respectively.

FIG. 6 shows a variant of the coating embodiment according to the invention.

FIG. 7 is a view of element 6 in FIG. 6 in direction F3.

DESCRIPTION OF THE PREFERRED EMBODIMENTS

Figure 1:
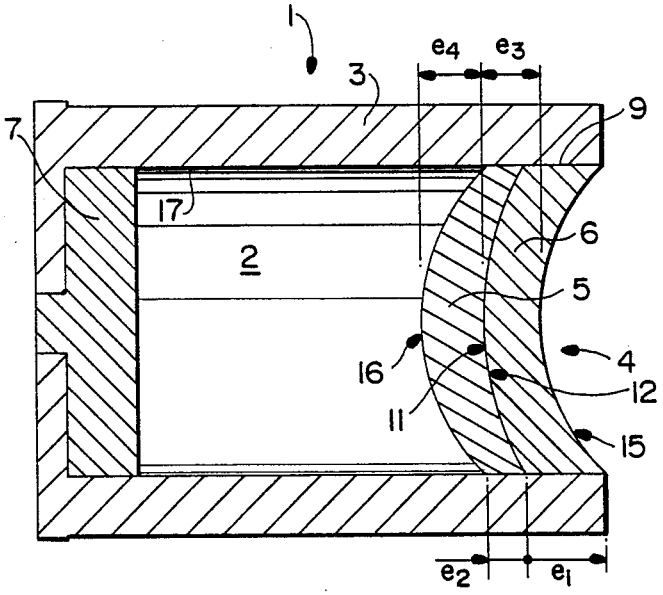
FIG. 1 is a schematic cross-section of an explosive charge according to the invention.

Referring to FIG. 1: an explosive charge 1 is constituted by an explosive matter 2 contained in a cylindrical housing 17 made in a box 3; the explosive matter includes, at one of its ends, a priming device 7 of a well-known type and, at the other end, a coating 4. This coating includes two plates in contact with the inner surface of the cylindrical housing 17, a so-called internal plate 5, which is in contact with the explosive matter, and a so-called external plate 6, in contact with internal plate 5 (the areas of contact being areas 12 for plate 5 and 11 for plate 6 respectively). In this specific embodiment shown in FIG. 1, the two plates present spherical areas 11 and 12, as well as area 15 in contact with the air and area 16 in contact with the explosive matter.

The external plate 6 is in contact with the housing 3 through a cylindrical area 9, its thickness e1 at the location of this contact being greater than its thickness e3 at the center. Conversely, the thickness of the internal plate 5 at the center e4 is greater than its thickness e2 at the edges. The constituent material of the external plate 6 is selected as a function of the constituent material of the internal plate 5. Its density is between 10% and 55% of the internal plate density. As an example, one can select an internal plate of Iron (density: 7800 kg/m$^3$) and an external plate of Aluminum (density: 2700 kg/m$^3$).

The device operates as follows: after detonation of the explosive matter, the constituent material of the internal plate 5 is violently compressed by the detonating products. Its expansion (in general destructive for charges according to the state of the art) is retarded by the compression, and then the expansion of the constituent material of the external plate 6. Therefore, the stresses generated in the internal plate 5 remain smaller than the breaking stress of the constituent material which has a high density; hence the absence of scaling and breaking of the latter and the generation of a core possessing the whole mass of the material of the internal plate 5.

Conversely, the expansions induced in the material with a small density which constitutes the external plate 6, at the location of its area 15 in contact with the air, result in its destruction. The loss of energy caused by this expansion remains relatively low if the total mass of the external plate is smaller than the mass of the internal plate.

The operation described above will be ensured correctly if the compressibility of the constituent material of the external plate is sufficiently low and, practically, smaller than or equal to 50% under a pressure of 50 Gigapascals. Most metals such as Aluminum, Iron, Nickel, Copper and Magnesium meet this criterion; other materials may be envisaged, such as Glass or ceramics.

Moreover, if for a charge with a coating including only one plate the final geometry of the projectile is given essentially by the initial distribution of velocities, which itself depends on the coating thickness and on the geometry of the explosive-coating interface, the device according to the invention makes it possible, by adapting the relative thicknesses of the two plates, to vary the final geometry of the projectile without changing the initial distribution of velocities. In the embodiment shown in FIG. 1, the thickness of the external plate 6 decreases from the edges to the center. This makes it possible, on the one hand, to avoid the scaling of plate 5 as described above, namely very effectively in its peripheral area where the risk of coating fragmentation is maximum, and, on the other, to obtain a larger area of contact 9 between the external plate and the box 3, which ensures a better confinement of the explosive matter 2, and results in reduction of the centripetal expansion of box 3 which is detrimental to the generation of a compact core. The energy transfer from the explosive matter to the coating is thus improved.

From the above description, it appears that, owing to the invention:

With a given projectile mass, for integrating a weapon system, it will be advantageous to use explosive charges fitted with a two-plate coating, the caliber and the mass of which may be smaller than those of the explosive charges fitted with a one-plate coating because, for the charges with a two-plate coating, the whole mass of the internal plate will remain in the core so obtained.

With a given charge caliber, the cores projected by a device according to the invention will have a greater mass, thus a lesser deceleration along their trajectory, and a better terminal effectiveness than with a one-plate coating.

The invention proposes also to provide a core which is aerodynamically stable along its trajectory.

Figure 3:
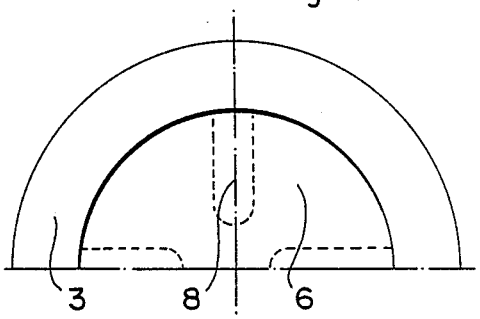
Figure 2:
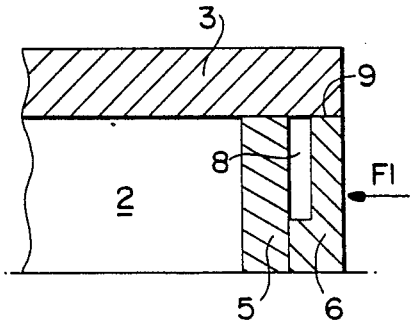

It is well known that the presence of fins at the rear of a projectile, for long-range fire, is a factor of stabilization. In the case of a projectile obtained by explosive deformation of a coating plate, it is possible to obtain "fins" by increating the fragility of the plate to be projected along radial segments starting from the edge of the plate. Upon deformation, the plate will tend naturally to bend along these segments. FIGS. 2 and 3 show how to obtain such a result while retaining the advantages of a two-layer coating.

The external plate 6 includes, on its area of contact with the internal plate 5, four radial grooves 8 starting from the bottom of the plate. The grooves, by leaving areas where the internal plate will be in contact with the air, determine localized expansion areas for this plate. These expansions will locally increase the fragility of the internal plate, creating bending areas resulting in the generation of stabilizing stub wings. The number of grooves may be increased; the relative angles formed by the grooves with one another must be equal for symmetry reasons for the final core (if there are N grooves, the relative angles are equal to $2\pi/N$ radians).

The central area of the internal plate, which has not been embrittled, will provide the core material located in the vicinity of the axis; this makes it possible to obtain cores with an important length-to-diameter ratio (the thickness of which increases from the edges to the center for this plate to have a similar effect).

Figure 8:
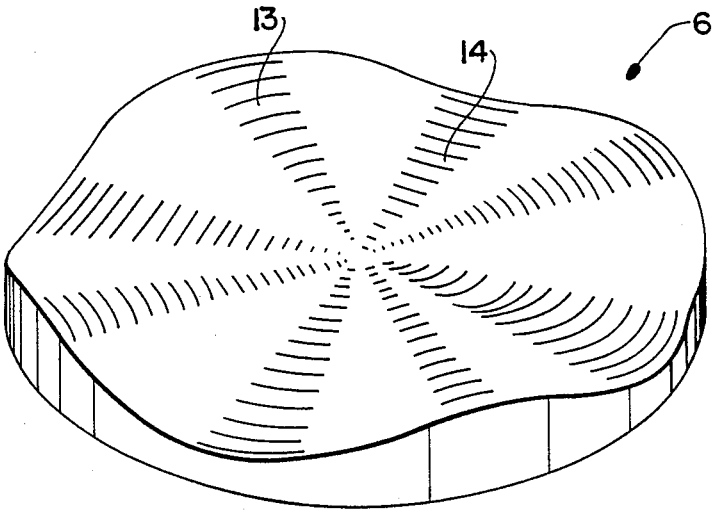
FIG. 8 is a perspective view of element 6 in FIG. 6.

FIGS. 6–8 propose another means for obtaining stub wings on the projected core. For that purpose, the areas of contact 11 and 12 of the two plates have a profile with undulations 13 and 14, regularly spaced. Their total number is $2\times P$. The plates have a symmetry plane of $P^{th}$ order with respect to their axes. In the specific embodiment represented, $P=4$. The plate 6 thus includes P areas with a reduced thickness (undulation 14).

The bending lines of plate 5 will be produced naturally due to the variation of expansion pressures along less resisting areas of plate 6, the thickness of which bears relation to the undulations of the area of contact.

As the scaling of a core-forming coating is much more important on the edges of the plate which constitute the coating, it is possible to produce (FIGS. 4 and 5) a two-plate coating, the external plate 6 of which is annular and thus presents an opening 10.

Other variants are possible within the framework of the invention; it is possible to give the areas of contact between the internal plate and the explosive matter, between the external plate and the air, or the areas of contact, various geometrical shapes such as: spheres, cones, plane plates or any convex areas defined point by point.

It can also be noted that, in some cases, when the core-forming plate is made of an oxidizable material, the external plate provides protection against corrosion.

Lastly, by using a detonation plane wave generator made of an oxidizable material as an explosive matter primer, the performance of the device described above can be improved substantially.

We claim:

1. A core-forming explosive charge including a coating set in motion by an explosive matter initiated by a priming device, wherein the coating comprises two superimposed and contiguous plates, an internal plate intended to form the core, one face of which is in contact with the explosive matter, and an external plate, one face of which is oriented toward the open air, the external plate being made of a material such that its density is between 15% and 55% of the density of the constituent material of the internal plate and its compressibility under 50 Gigapascals is less than or equal to 50%, the total mass of the external plate being less than the total mass of the internal plate, and the external plate thickness on its edges being greater than 125% of the internal plate thickness on its edges.

2. An explosive charge as claimed in claim 1, wherein the area of contact of the internal plate with the external plate is a conical area the apex of which is oriented toward the explosive matter and the apex angle of which is greater than or equal to 110°.

3. An explosive charge as claimed in claim 1, wherein the area of contact of the internal plate with the external plate is a spherical area the convexity of which is oriented toward the explosive matter and the diameter of which is greater than 0.5 times the explosive matter diameter.

4. An explosive charge as claimed in claim 3, wherein the thickness of the external plate is decreasing from its edges to its center.

5. An explosive charge as claimed in claim 4, wherein the thickness of the internal plate is increasing from its edges to its center.

6. An explosive charge as claimed in claim 5, wherein the external plate is annular.

7. An explosive charge as claimed in claim 5, wherein the external plate includes on its area of contact with the internal plate a certain number N of radial grooves starting from its edges and forming an angle of $2\pi/N$ radians with one another.

8. An explosive charge as claimed in claim 5, wherein the areas of relative contact between the external plate and the internal plate include undulations a certain number P of which correspond to a reduced plate thickness, the said areas of contact showing a symmetry of $P^{th}$ order with regard to their respective axes.

9. An explosive charge as claimed in claim 5, wherein the internal plate is made of a material selected from the group consisting of Uranium and Tantalum, and the external plate is made of a material selected from the group consisting of Iron, Nickel, Aluminum, Titanium, Glass and alloys thereof.

10. An explosive charge as claimed in claim 5, wherein the internal plate is made of a material selected from the group consisting of Iron, Copper, Nickel and Molybdenum, and the external plate is made of a material selected from the group consisting of Titanium, Aluminum, Magnesium and Glass.

11. An explosive charge as claimed in claim 5, wherein the priming device is a detonation plane wave generator.

* * * * *